US006912371B2

(12) United States Patent
Sato

(10) Patent No.: US 6,912,371 B2
(45) Date of Patent: Jun. 28, 2005

(54) SYSTEM FOR REGULATING THE SLIDING FORCE OF A FUSING BELT IN AN IMAGE FORMING APPARATUS

(75) Inventor: Yoji Sato, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 31 days.

(21) Appl. No.: 10/608,066

(22) Filed: Jun. 30, 2003

(65) Prior Publication Data

US 2004/0265019 A1 Dec. 30, 2004

(51) Int. Cl.[7] ..... G03G 15/20
(52) U.S. Cl. ..... 399/329; 198/840; 474/122
(58) Field of Search ..... 399/162, 165, 399/312, 313, 329; 219/216; 198/840; 474/122, 140

(56) References Cited

U.S. PATENT DOCUMENTS 4,221,480 A * 9/1980 Spehrley, Jr. ..... 399/165
4,286,706 A * 9/1981 Castelli et al. ..... 198/806
5,070,365 A * 12/1991 Agarwal ..... 399/165
5,257,078 A * 10/1993 Kuroda ..... 399/329
5,740,511 A * 4/1998 Todome ..... 399/303
5,960,243 A * 9/1999 Daigo et al. ..... 399/329
6,002,908 A * 12/1999 Hayashi et al. ..... 399/312

* cited by examiner

*Primary Examiner*—Robert Beatty
(74) *Attorney, Agent, or Firm*—Foley & Lardner LLP

(57) ABSTRACT

An image forming apparatus includes a roller having a central portion and an outer edge portion, a fusing belt positioned over at least a portion of the central portion of the roller, and a belt regulating part, positioned on the outer edge portion of the roller, that impedes the fusing belt from moving onto the outer edge portion of the roller. The belt regulating part includes a first portion having a surface adjacent to the central portion of the roller and an edge of the fusing belt. The first portion is configured to contact the fusing belt if the fusing belt moves toward the outer edge portion of the roller. The belt regulating part also includes a second portion coupled to the first portion, the second portion having an interior surface that contacts with the outer edge portion of the roller during operation of the image forming apparatus to cause the regulating part to rotate in conjunction with the rotation of the roller and the fusing belt.

15 Claims, 8 Drawing Sheets

SYSTEM FOR REGULATING THE SLIDING FORCE OF A FUSING BELT IN AN IMAGE FORMING APPARATUS

FIELD OF THE INVENTION

The present invention relates generally to image processing and, more particularly, to a system and method for regulating the sliding force of a fusing belt in an image forming apparatus.

BACKGROUND OF THE INVENTION

A conventional image forming apparatus includes a fusing unit, which fuses a latent image onto a document. The fusing unit typically includes a heat roller, a fusing roller, a fusing belt stretched across the heat roller and the fusing roller, and a press roller proximate to either the heat roller or the fusing roller. The latent image is fused on the document when it passes between the press roller and the fusing belt on either the heat roller or the fusing roller.

The fusing belt rotates by rotation of the heat and fusing rollers. This fusing belt rotation results in a sliding force that may move the fusing belt away from its central position on the rollers towards the edge of the rollers. This sliding can result in improper fusion of the latent image to the document.

To avoid this sliding, a regulating part is placed on an edge of the rollers. In the conventional image forming apparatus, the regulating part is place over an edge portion of the roller and is fixed to a wall or other fixed (non-moving) portion of the image forming apparatus. FIG. 1 shows a portion of a fusing unit in an image forming apparatus including a conventional regulating part. As shown in FIG. 1, the fusing unit includes a roller 1, a fusing belt 2, a regulating part 3, and a fixed portion 4. The regulating part 3 is coupled to the fixed portion 4 by a fixing element 5, such as a screw. The fixed portion 4 is also coupled to a bridge portion 6 positioned at the end of the roller 1 to enable roller 1 to rotate.

Although the regulating part 3 counteracts the sliding force and maintains the fusing belt 2 in its proper position on roller 1, the conventional design of FIG. 1 results in other drawbacks. With the fixed regulating part 3, the fusing belt 2 contacts the regulating part 3 when the roller 1 rotates, generating a friction force between the moving fusing belt 2 and the fixed regulating part 3. The generated friction force damages the fusing belt 2, requiring replacement of the fusing belt, which increases the costs for operating the image forming apparatus, and increases the down time of the image forming apparatus.

In addition, the image forming apparatus typically drives either the fusing roller or the heat roller with a motor, and the other roller is left free standing. This design results in a high tension force on one side of the fusing belt 2, i.e., the side being pulled toward the motorized roller. The high tension force causes the portion of the regulating part 3 on the side corresponding to the high tension force to be carved deeply. As a result, the regulating part needs to be replaced as well.

Accordingly, it would be desirable to have a regulating part which improves the operation of the fusing apparatus and the life cycle of the fusing belt.

SUMMARY OF THE INVENTION

According to an aspect of the invention, an image forming apparatus includes a roller having a central portion and an outer edge portion, a fusing belt positioned over at least a portion of the central portion of the roller, and a belt regulating part, positioned on the outer edge portion of the roller, that impedes the fusing belt from moving onto the outer edge portion of the roller. The belt regulating part includes a first portion having a surface adjacent to the central portion of the roller and an edge of the fusing belt. The first portion is configured to contact the fusing belt if the fusing belt moves toward the outer edge portion of the roller. The belt regulating part also includes a second portion coupled to the first portion, the second portion having an interior surface that contacts with the outer edge portion of the roller during operation of the image forming apparatus to cause the regulating part to rotate in conjunction with the rotation of the roller and the fusing belt.

Further features, aspects and advantages of the present invention will become apparent from the detailed description of preferred embodiments that follows, when considered together with the accompanying figures of drawing.

DETAILED DESCRIPTION OF THE PREFERRED EMBODIMENT

Figure 1:
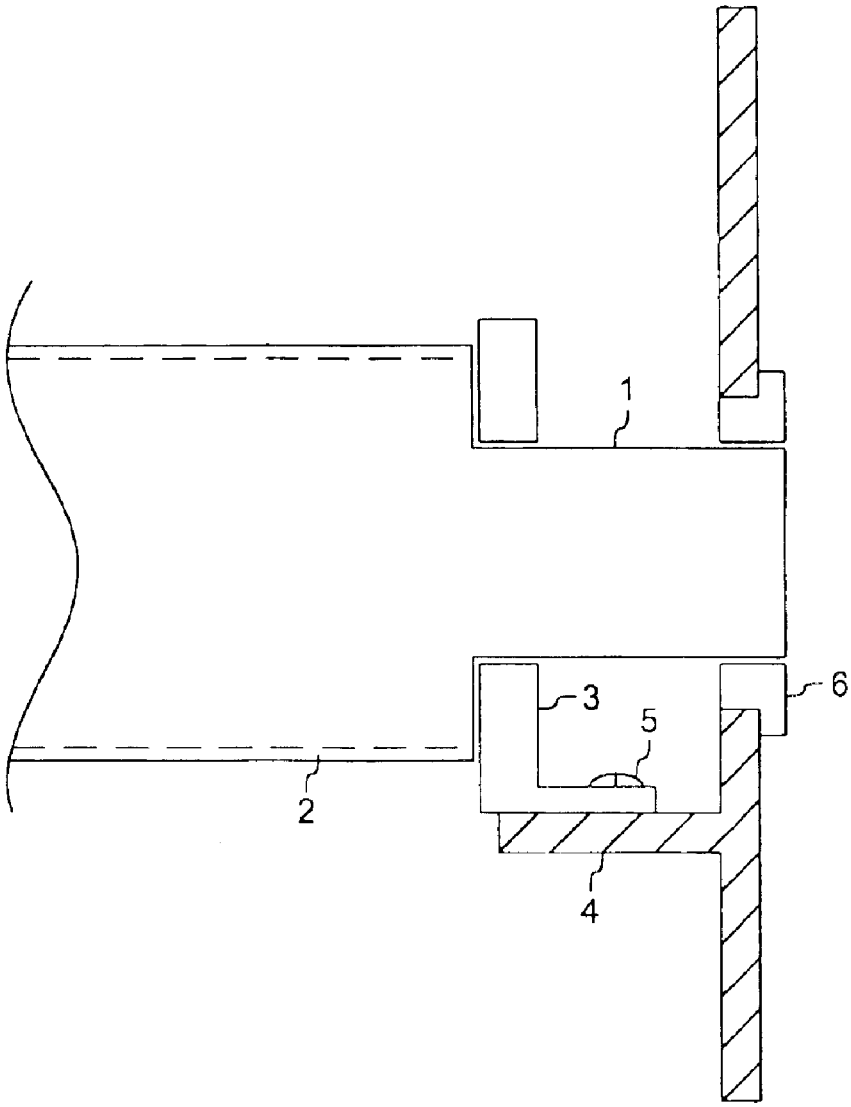
FIG. 1 PRIOR ART
FIG. 1 is a diagram of a portion of a fusing unit in an image forming apparatus having a conventional regulating part.
Figure 2:
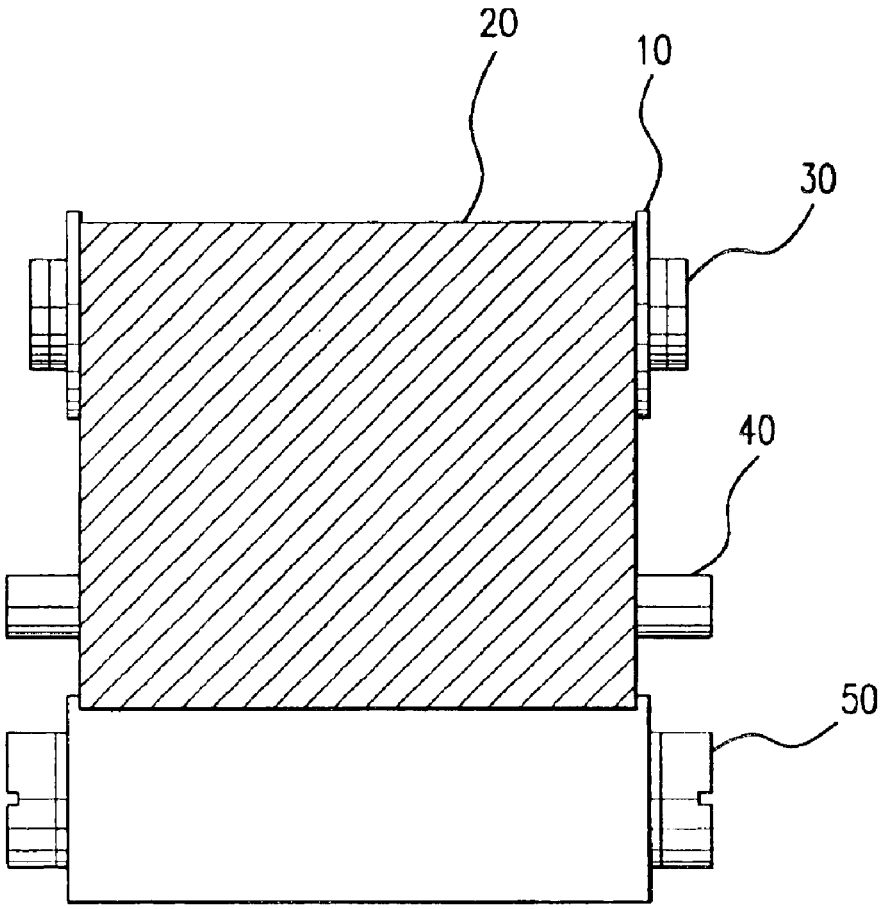
FIG. 2 is a diagram of a fusing unit of an image forming apparatus consistent with the present invention.

FIG. 2 is a diagram of a fusing unit of an image forming apparatus consistent with the present invention. As shown in FIG. 2, the fusing unit includes a regulating part 10, a fusing belt 20, a roller 30, a roller 40, and a press roller 50. In the embodiment as illustrated, roller 30 is a heat roller, and roller 40 is a fusing roller, though they can be interchanged.

In operation, the roller 30 is driven by a motor, which causes the fusing belt 20 to rotate around the rollers 30 and 40. A document, or other medium for receiving a latent image, is passed between the press roller 50 and the fusing belt 20, to fuse the latent image to the medium.

As described above, the rotation of the fusing belt 20 results in a sliding force that may move the fusing belt 20 away from its central position on the roller 30 and toward one edge of the heat roller 30. To maintain the fusing belt 20 in its proper position, the regulating part 10 is positioned on the edge of the roller 30. The maintenance of the position of the fusing belt 20 is shown more particularly in FIG. 3.

Figure 3:
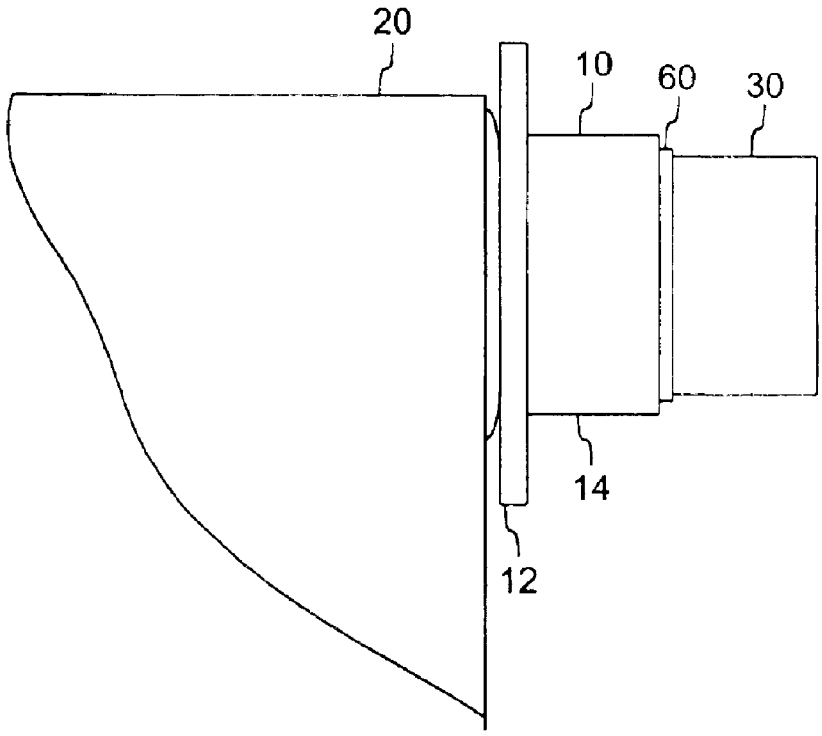
FIG. 3 is a diagram of a portion of the fusing unit of FIG. 2.

FIG. 3 is a diagram of a portion of the fusing unit of FIG. 2. As shown in FIG. 3, the regulating part 10 (which can be on one or both ends of the roller) includes a first portion 12 and a second portion 14. In addition, the fusing unit also includes a stopper 60 positioned over the edge of the roller 30. The stopper 60 keeps the regulating part 10 from sliding off of the roller 30.

The first portion 12 of the regulating part 10 has an external circumference greater than an external circumference of the second portion 14. In this embodiment, the external circumference of the first portion 12 also exceeds the combined external circumference of the fusing belt 20 over the central wider portion of the roller 30. If during operation the fusing belt 20 slides toward the edge of the roller 30, the surface of the first portion 12 facing the fusing belt 20 keeps the fusing belt 20 from sliding off its proper position on the roller 30.

The regulating part 10 is not secured to any fixed portion of the image forming apparatus. As a result, the regulating part can rotate in conjunction or synchronously with the rollers 30 and 40 and the fusing belt 20. By rotating in conjunction with the rollers 30 and 40 and the fusing belt 20, the regulating part 10 can avoid the wearing down of the fusing belt 20 otherwise caused by friction between the moving fusing belt 20 and a stationary regulating part, as well as the wearing down of the regulating part 10 itself due to this friction and the high tension force derived from driving the roller 30 (and/or roller 40).

When the rollers 30 and 40 are rotating and moving the fusing belt 20, the roller implemented as the heat roller, such as roller 30, can be heated by a heater, which is typically located within the roller. When the heater is off, there is a clearance between the internal surface of the regulating part 10 and the external surface of the edge portion of the roller 30. Due to this clearance, the rotation of the roller 30 does not necessarily cause the regulating part 10 to rotate. However, the rotation of the rollers 30 and 40 produces a sliding force on the fusing belt 20. The sliding of the fusing belt 20 moves the belt toward the surface of the first portion 12 of the regulating part 10 that faces the fusing belt 20. When the fusing belt 20 contacts this surface, the regulating part 10 can move slightly laterally, but is kept from further lateral movement by the stopper 60. Then, the friction force between the edge of the fusing belt 20 and the surface of the first portion 12 of the regulating part 10, as well as the friction force between the stopper 60 and a surface of the second portion 14 of the regulating part 10, causes the regulating part 10 to rotate in conjunction or synchronously with the rollers 30 and 40 and the fusing belt 20.

When the heater is on, it causes the heat roller (in this example, roller 30), to thermally expand. The heater also causes the regulating part 10 to thermally expand. The regulating part 10 and the roller 30 may be made from different materials with different thermal expansion properties. For example, the regulating part 10 may be formed from a material such as polyphenylene sulfide or polyether ether keton, and the roller 30 may be made from a material such as aluminum or stainless steel. If the roller 30 thermally expands more than the regulating part 10, then the expansion of the roller 30 causes the external surface of the edge portion of the roller 30 to contact the internal surface of the regulating part 10, and eliminate any clearance between them. With this expansion and elimination of the clearance, regulating part 10 will rotate synchronously with the roller 30.

The increased diameters (or equivalently circumferences) of the roller 30 and regulating part 10 can be monitored using a temperature detection device. The temperature detection device can implemented, for example, as a thermistor in the fusing unit. By monitoring temperature, the image forming apparatus can calculate the number of rotations of the regulating part 10 to thereby judge whether or not the roller 30 is driving it. If the regulating part is not being driven by the roller 30, then an appropriate message can be displayed on the image forming apparatus, such as on an LCD control panel. A message that the regulating part 10 is not rotating may indicate that the fusing unit is not operating properly.

To facilitate the rotation of the regulating part 10, it is preferable to increase the surface roughness on the external surface of the edge portion of the roller 30 where the regulating part 10 is positioned. The surface roughness can be increased by applying an appropriate coating on part or all of the surface of the roller 30.

Figure 4:
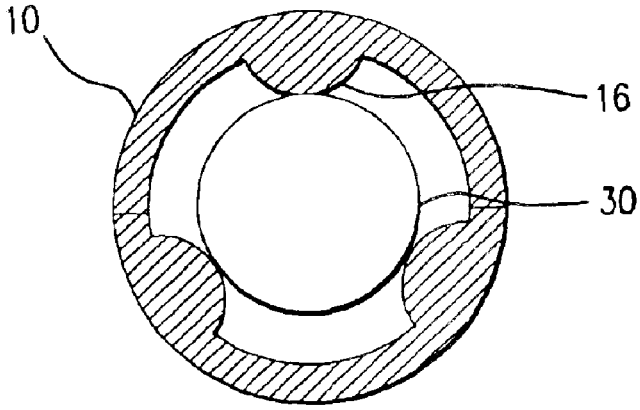
FIG. 4 is a diagram of a regulating part consistent with the present invention.

When the roller 30 and the regulating part 10 are made from different materials, the regulating part 10 may crack due to the larger and faster thermal expansion of the roller 30 resulting from the different coefficient of thermal expansion and thermal conductivity of the different materials. To avoid such cracking, the regulating part 10 is preferably designed to accommodate the larger and faster thermal expansion of the roller 30. FIG. 4 is a diagram of an exemplary regulating part consistent with the present invention.

As shown in FIG. 4, the regulating part 10 includes a plurality of ribs 16. The number of ribs 16 shown is three, although the number of ribs may be more or less than three. Three or more ribs preferably reduces the likelihood of the regulating part 10 tilting with respect to the roller 30. The diagram of FIG. 4 shows the regulating part 10 and roller 30 in a cooled state, i.e., where the heater is off. Although no clearance is shown between the ribs 16 and the roller 30, it is possible for there to be some clearance between them, or at least insufficient contact for the regulating part 10 to be rotated by the roller 30.

Figure 5:
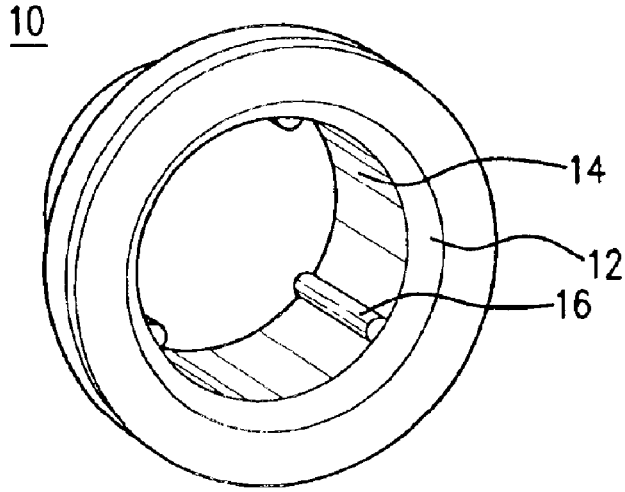
FIG. 5 is a perspective view of the regulating part of FIG. 4.

FIG. 5 is a perspective view of the regulating part of FIG. 4. The regulating part 10 includes the first portion 12 and the second portion 14, as well as the ribs 16. As shown in FIG. 5, the ribs 16 are only formed in the interior surface of the second portion 14. The interior surface of the first portion 12 proximate to the second portion 14 slopes away from the interior surface of the second portion 14, making it unnecessary to extend the ribs 16 to the first portion 12. If the interior surface of the first portion 12 is configured to have the same diameter (or equivalently circumference) as the interior surface of the second portion 14, then the ribs 16 may extend to the first portion 12. The sloped design of the interior surface of the first portion 12 preferably matches a sloped design of the exterior surface of the roller 30 at a location where the edge portion of the roller 30 having the smaller diameter meets the central portion of the roller 30 having the larger diameter.

Figure 6:
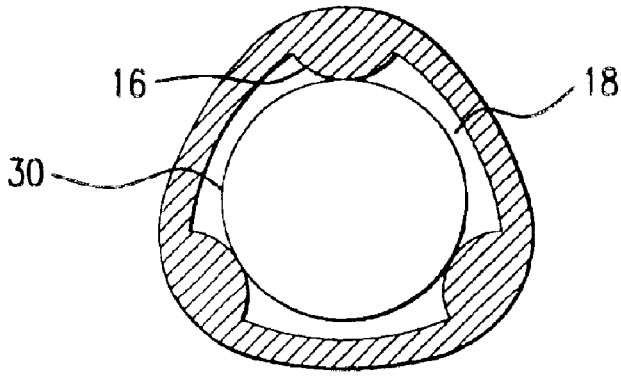
FIG. 6 is a diagram of the regulating part of FIG. 4 deformed by the expansion of a roller during the operation of the image forming apparatus.

When the roller 30 and regulating part 10 are formed with different materials such that the roller 30 thermally expands a greater amount and faster than the regulating part 10, the roller 30 causes the regulating part to deform. FIG. 6 is a diagram of the regulating part of FIG. 4 exemplifying how it may be deformed by the expansion of a roller during the operation of the image forming apparatus. As shown in FIG. 6, the roller 30 contacts the ribs 16 of the regulating part, causing the shape of the regulating part to deform. In particular, relief portions 18 are formed between each of the ribs 16. To ensure that the regulating part 10 does not crack, it is preferable that any weld lines for making the regulating part are located on the ribs 16 and not on the relief portions 18 as the relief portions 18 are likely to have greater deformation than the ribs 16.

Figure 7A:
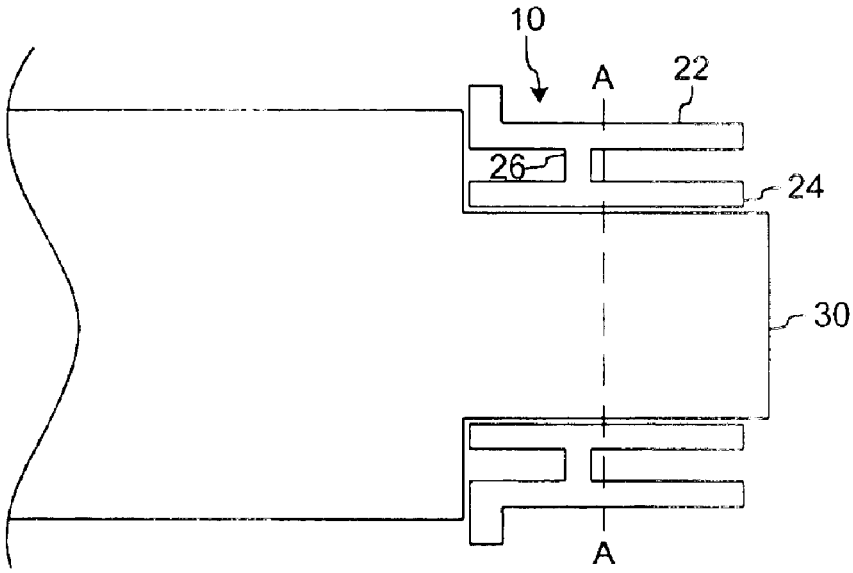
FIGS. 7A and 7B are diagrams of another regulating part consistent with the present invention.
Figure 7B:
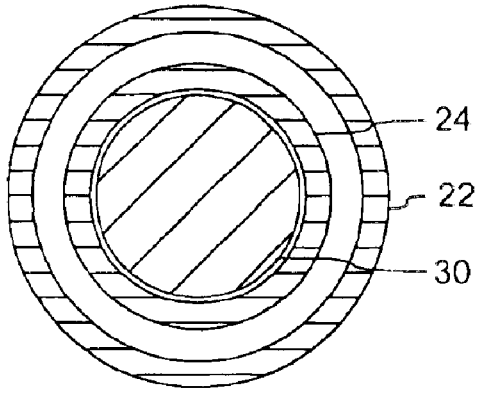

The regulating part 10 can have alternative configurations that also are capable of rotating synchronously with the rollers 30 and 40 and the fusing belt 20 while maintaining the position of the fusing belt 20. FIGS. 7A and 7B are diagrams of an alternative regulating part consistent with the present invention. As shown in FIG. 7A, the regulating part 10 includes an external portion 22, and internal portion 24, and a bridge portion 26 coupling the external portion 22 to the internal portion 24.

The internal portion 24 is preferably made of a material that is expandable that can tolerate the thermal expansion of the roller 30. The internal portion 24 can be made of a material such as polyphenylene sulfide or polyether ether keton. Conversely, the bridge portion 26 is preferably made of a compressible material that can similarly tolerate the thermal expansion of the roller 30. The bridge portion 26 can be made of a material such as polyphenylene sulfide or polyether ether keton. The bridge portion 26 can be a continuous ring formed between the external portion 22 and the internal portion 24. Alternatively, the bridge portion 26 can comprise one or more sections or pieces connecting the external portion 22 to the internal portion 24.

When the heater is off, the interior surface of the internal portion 24 can be snugly in contact with the exterior surface of the roller 30 or there can be a some clearance between them. When the heater is on, the thermal expansion of the roller 30 causes the exterior surface of the edge portion of the roller 30 to contact the interior surface of the interior portion 24, thereby causing the interior portion 24 to expand in a radial direction. When the internal portion 24 expands, the bridge portion 26 is compressed. In addition, the snug contact of the roller 30 to the internal portion of the regulating part 10 causes the regulating part 10 to rotate synchronously with the roller 30. By using an expandable material for the internal portion 24 and a compressible material for the bridge portion 26, the regulating part 10 can accommodate the thermal expansion of the roller 30 without cracking, and rotate synchronously with the roller 30.

Figure 8:
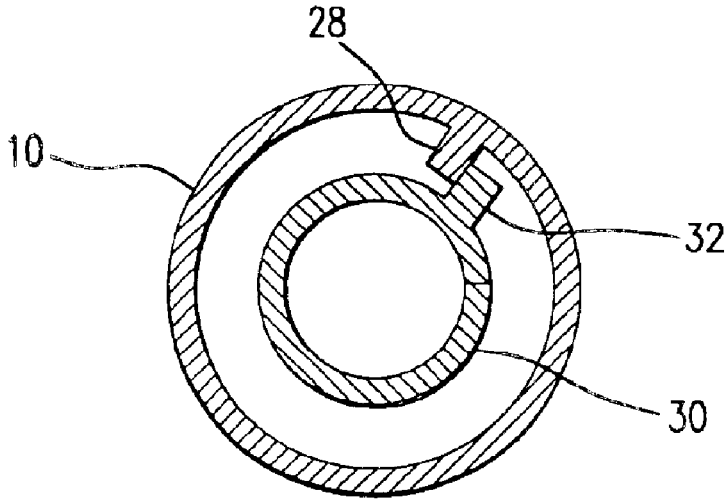
FIG. 8 is a diagram of another regulating part consistent with the present invention.

FIG. 8 is a diagram of another alternative regulating part consistent with the present invention. As shown in FIG. 8, the roller 30 includes a rib portion 32, and the regulating part 10 similarly includes a rib portion 28. When the roller 30 rotates during the operation of the image forming apparatus, the rib portion 32 of the roller 30 contacts the rib portion 28 of the regulating part 10, which causes the regulating part 10 to rotate synchronously with the roller 30.

Any other form of contact regions can exist between the roller and the regulating part, such as respective ribs, dots, or protrusions. The shape of the regulating part can even have areas of recess that will contact the roller.

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiments (which can be practiced separately or in combination) were chosen and described in order to explain the principles of the invention and as practical application to enable one skilled in the art to utilize the invention in various embodiments and with various modifications are suited to the particular use contemplated. It is intended that the scope of the invention be defined by the claims appended hereto and their equivalents.

What is claimed is:

1. An image forming apparatus, comprising:

a roller having a central portion and an outer edge portion;

a fusing belt positioned over at least a portion of the central portion of the roller; and a belt regulating part, positioned on the outer edge portion of the roller, that impedes the fusing belt from moving onto the outer edge portion of the roller, the belt regulating part comprising:

a first portion having a surface adjacent to the central portion of the roller and an edge of the fusing belt, the first portion is configured to contact the fusing belt if the fusing belt moves toward the outer edge portion of the roller; and a second portion coupled to the first portion, the second portion having an interior surface that contacts with the outer edge portion of the roller during operation of the image forming apparatus to cause the regulating part to rotate in conjunction with the rotation of the roller and the fusing belt, wherein the interior surface of the second portion of the belt regulating part includes at least one contact region which contacts an exterior surface of the edge portion of the roller during the operation of the image forming apparatus, and wherein the edge portion of the roller thermally expands during the operation of the image forming apparatus, and the at least one contact region contacts the exterior surface of the outer edge portion of the roller and belt regulating part deforms.

2. An image forming apparatus comprising:

a roller having a central portion and an outer edge portion;

a fusing belt positioned over at least a portion of the central portion of the roller; and a belt regulating part, positioned on the outer edge portion of the roller, that impedes the fusing belt from moving onto the outer edge portion of the roller, the belt regulating part comprising:

a first portion having a surface adjacent to the central portion of the roller and an edge of the fusing belt, the first portion is configures to contact the fusing belt if the fusing belt, the first portion is configures to contact the fusing belt if the fusing belt moves toward the outer edge portion of the roller; and a second portion coupled to the first portion, the second portion having an interior surface that contacts with the outer edge portion of the roller during operation of the image forming apparatus to cause the regulating part of the rotate in conjunction with the rotation of the roller and the fusing belt, wherein the interior surface of the second portion the belt regulating part includes at least one contact region, and wherein a circumference of an interior surface of the second portion of the belt regulating part is greater than a circumference of the outer edge of the roller during a time when the image forming apparatus is not operating.

3. An image forming apparatus comprising:

a roller having a central portion and an outer edge portion;

a fusing belt positioned over at least a portion of the central portion of the roller; and a belt regulating part, positioned on the outer edge portion of the roller, that impedes the fusing belt from moving onto the outer edge portion of the roller, the belt regulating part comprising:

a first position having a surface adjacent to the central portion of the roller and an edge of the fusing belt, the first portion is configures to contact the fusing belt if the fusing belt moves toward the outer edge portion of the roller, and a second portion coupled to the first portion, the second portion having an interior surface that contacts with the outer edge portion of the roller during operation of the image forming apparatus to cause the regulating part of the rotate in conjunction with the rotation of the roller and the fusing belt, wherein the interior surface of the second portion of the belt regulating part includes at least one contact region which comprises a plurality of rib portions, and wherein at least one rib portion of the plurality of rib portions does not contact an exterior surface of the edge portion of the roller when the image forming apparatus is not operating.

4. An image forming apparatus according to claim 3, wherein the plurality of rib portions comprises at least three rib portions.

5. An image forming apparatus according to claim 3, wherein only the plurality of rib portion contact the roller when the image forming apparatus is operating.

6. An image forming apparatus comprising:

a roller having a central portion and an outer edge portion;

a fusing belt positioned over at least a portion of the central portion of the roller; and a belt regulating part, positioned on the outer edge portion of the roller, that impedes the fusing belt from moving onto the outer edge portion of the roller, the belt regulating part comprising:

a first portion having a surface adjacent to the central portion of the roller and an edge of the fusing belt, the first portion is configured to contact the fusing belt if the fusing belt moves toward the outer edge portion of the roller; and a second portion coupled to the first portion, the second portion having an interior surface that contacts with the outer edge portion of the roller during operation of the image forming apparatus to cause the regulating part to rotate in conjunction with the rotation of the roller and the fusing belt, wherein the second portion of the belt regulating part includes an interior section, an exterior section, and a bridge portion that couples the interior section to the exterior section.

7. An image forming apparatus according to claim 6, wherein the interior section is formed of a thermally expandable material, and the bridge portion is formed of a compressible material.

8. An image forming apparatus according to claim 6, wherein the interior section contacts the outer edge portion of the roller during the operation of the image forming apparatus.

9. An image forming apparatus according to claim 8, wherein the outer edge portion of the roller thermally expands during the operation of the image forming apparatus to cause the interior section to radially expand and compress the bridge portion.

10. An image forming apparatus according to claim 6, wherein a thermal expansion property of the belt regulating part is different than a thermal expansion property of the roller.

11. An image forming apparatus comprising:

a roller having a central portion and an outer edge portion;

a fusing belt positioned over at least a portion of the central portion of the roller; and a belt regulating part, positioned on the outer edge portion of the roller, that impedes the fusing belt from moving onto the outer edge portion of the roller, the belt regulating part comprising:

a first portion having a surface adjacent to the central portion of the roller and an edge of the fusing belt, the first portion is configured to contact the fusing belt if the fusing belt moves toward the outer edge portion of the roller; and a second portion coupled to the first portion, the second portion having an interior surface that contacts with the outer edge portion of the roller during operation of the image forming apparatus to cause the regulating part to rotate in conjunction with the rotation of the roller and the fusing belt, wherein an exterior surface of the outer edge portion of the roller includes an extension rib, and the second portion of the belt regulating part includes a cooperating extension rib on an interior surface.

12. An image forming apparatus according to claim 11, wherein rotation of the roller during operation of the image forming apparatus causes the extension rib of the roller to contact the cooperating extension rib of the belt regulating part to rotate the belt regulating part in conjunction with the rotation of the roller.

13. An image forming apparatus comprising:

a roller having a central portion and an outer edge portion;

a fusing belt positioned over at least a portion of the central portion of the roller; and a belt regulating part, positioned on the outer edge portion of the roller, that impedes the fusing belt from moving onto the outer edge portion of the roller, the belt regulating part comprising:

a first portion having a surface adjacent to the central portion of the roller and an edge of the fusing belt, the first portion is configured to contact the fusing belt if the fusing belt moves toward the outer edge portion of the roller; and a second portion coupled to the first portion, the second portion having an interior surface that contacts with the outer edge portion of the roller during operation of the image forming apparatus to cause the regulating part to rotate in conjunction with the rotation of the roller and the fusing belt, wherein a thermal expansion property of the belt regulating part is different than a thermal expansion property of the roller.

14. An image forming apparatus, comprising:

a roller having a central portion and an outer edge portion;

a fusing belt positioned over at least a portion of the central portion of the roller; and a belt regulating part, positioned on the outer edge portion of the roller, that impedes the fusing belt from moving onto the outer edge portion of the roller, the belt regulating part comprising:

a first portion having a surface adjacent to the central portion of the roller and an edge of the fusing belt, the first portion is configures to contact the fusing belt if the fusing belt moves toward the outer edge portion of the roller; and a second portion coupled to the first portion, the second portion having an interior surface that contacts with the outer edge portion of the roller during operation of the image forming apparatus to cause the regulating part to rotate in conjunction with the rotation of the roller and the fusing belt, wherein the belt regulating part comprises a plurality of ribs provided on the interior surface of the second portion and is kept rotation free, and wherein the belt regulating part is rotated synchronously with the roller when the fusing belt contacts the first portion by moving along the outer edge portion of the roller.

15. An image forming apparatus according to claim 14, further comprising a stopper positioned on the outer edge portion of the roller, axially outside the belt regulating part along the outer edge portion of the roller, to maintain the position of the belt regulating part on the outer edge portion of the roller.

* * * * *